US006297191B1

(12) United States Patent
Puranik et al.

(10) Patent No.: US 6,297,191 B1
(45) Date of Patent: Oct. 2, 2001

(54) METAL COMPLEXING

(75) Inventors: Dhananjay Puranik, Alexandria, VA (US); Robert E. Morris; Eddie L. Chang, both of Silver Spring, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/532,860

(22) Filed: Mar. 22, 2000

Related U.S. Application Data

(62) Division of application No. 08/687,115, filed on Jul. 18, 1996, now Pat. No. 6,077,421.

(51) Int. Cl.[7] ..... B01S 20/22
(52) U.S. Cl. ..... 502/401; 210/198.2
(58) Field of Search ..... 502/401; 210/198.2

(56) References Cited

U.S. PATENT DOCUMENTS

| | | | | |
|---|---|---|---|---|
| 2,818,323 | * | 12/1957 | Haensel | 502/401 |
| 2,963,441 | * | 12/1960 | Dolian et al. | 502/401 |
| 3,396,122 | * | 8/1968 | Brauer | 502/401 |
| 3,839,385 | * | 10/1974 | Meiller et al. | 502/401 |
| 3,864,327 | * | 2/1975 | Marchant | 502/401 |
| 3,888,877 | * | 6/1975 | Lehn | 502/401 |
| 3,892,678 | * | 7/1975 | Halasz et al. | 502/401 |
| 3,901,818 | * | 8/1975 | Durand et al. | 502/401 |
| 3,960,720 | * | 6/1976 | Porath et al. | 502/401 |
| 4,033,764 | * | 7/1977 | Colegate et al. | 423/139 |
| 4,121,946 | * | 10/1978 | Chuiko et al. | 502/401 |
| 4,199,330 | * | 4/1980 | Nestrick et al. | 502/401 |
| 4,242,227 | * | 12/1980 | Nestrick et al. | 502/401 |
| 4,245,005 | * | 1/1981 | Regnier et al. | 502/401 |
| 4,650,784 | * | 3/1987 | Ramsden et al. | 502/401 |
| 4,959,340 | * | 9/1990 | Williams | 502/401 |
| 4,994,429 | * | 2/1991 | Wieserman et al. | 502/401 |
| 5,066,395 | * | 11/1991 | Ramsden et al. | 502/401 |
| 5,080,779 | * | 1/1992 | Awbrey et al. | 208/252 |
| 5,084,430 | * | 1/1992 | Tarbet et al. | 502/401 |
| 5,137,627 | * | 8/1992 | Feibush | 502/401 |
| 5,149,426 | * | 9/1992 | Watabe et al. | 502/401 |
| 5,203,991 | * | 4/1993 | Kutsuna et al. | 502/401 |
| 5,346,618 | * | 9/1994 | Horwitz et al. | 502/401 |
| 5,914,044 | * | 6/1999 | Lindoy et al. | 502/401 |
| 5,925,253 | * | 7/1999 | Pohl et al. | 210/198.2 |
| 6,017,458 | * | 1/2000 | Ng et al. | 210/198.2 |
| 6,077,421 | * | 6/2000 | Puranik et al. | 208/252 |
| 6,232,265 | * | 5/2001 | Bruening et al. | 210/198.2 |

FOREIGN PATENT DOCUMENTS

WO 95/35165 * 12/1995 (WO) .

OTHER PUBLICATIONS

Aldrich Chemical Company, Inc., catalog, p. 1197, 1990.*

* cited by examiner

*Primary Examiner*—Mark L. Bell
*Assistant Examiner*—J. Pasterczyk
(74) *Attorney, Agent, or Firm*—John J. Karasek; George A. Kap

(57) ABSTRACT

A composition including a solid substrate, a metal chelant, and a saturated hydrocarbon linker attached between the substrate and the chelant, wherein the chelant is an organic wherein the chelant is an organic macrocycle or polyol.

9 Claims, No Drawings

METAL COMPLEXING

This application is a divisional of U.S. Ser. No. 08/687115, filed Jul. 18, 1996, now U.S. Pat. No. 6,077,421.

FIELD OF INVENTION

This invention pertains to metal removal from liquids.

DESCRIPTION OF PRIOR ART

Trace quantities of metals can promote unwanted oxidative processes in organic systems. While iron, zinc and lead can lead to oxidative degradation of hydrocarbon fuels, copper is believed to comprise the most prevalent and active instability promoters. Freshly refined hydrocarbon fuels generally do not contain any copper although trace amounts of copper can be introduced into the fuels during the copper sweetening process or from the contact of refinery streams with copper lines, brass fittings, admiralty metal, and other copper-bearing alloys. Copper concentrations as low as about 50 ppb are believed to exert a marked effect on fuel stability. In gas-drive fuel coker tests, as little as 15–25 ppb of added copper or iron and 100–250 ppb of added zinc or lead appear to have deleterious effects on fuel thermal stability.

Metal-deactivator additives have been employed as one approach to reduce the catalytic activity of the dissolved metals. These additives are intended to reduce activity of the dissolved metals through formation of chelate complexes which are not intended to be deleterious to fuel stability. The problem with such an approach is that since the chelate complexes are soluble in the fuel, they are introduced into engines where they undergo thermal degradation at high temperature. Thermal degradation of the chelate complexes can lead to the release of catalytically active metals which can result in undesirable deposition on engine surfaces and other undesirable consequences.

SUMMARY OF INVENTION

An object of this invention is the removal of metals, particularly heavy metals such as copper, from a medium, particularly a liquid hydrocarbon fuel.

Another object of this invention is removal of copper from a hydrocarbon fuel to a level below 20 ppb.

Another object of this invention is removal of a metal from a medium with an immobilized chelant material in a quick and facile fashion.

These and other objects of this invention can be accomplished by contacting a medium containing a metal with an immobilized chelant material which has a chelant attached to a linker and the linker attached to a solid substrate.

DETAILED DESCRIPTION OF INVENTION

Immobilized chelant material and a process for removing at least one metal from a liquid medium using the immobilized chelant material. The immobilized chelant material includes a chelant, a linker and a solid substrate. The linker attaches the chelant to this substrate. Purpose of the substrate is to act as a support to which the linker is attached. Purpose of the linker is to facilitate contact of the chelant with a hydrocarbon medium and as a point of attachment for the chelant. Purpose of the chelant is to chelate soluble metal in the medium.

The substrate is in a solid state and can take the form of a support of any shape or form, including beads. The substrate can be a polymer or a metal oxide such as a ceramic. Examples of polymers include polystyrene, polyethylene, polyvinyl chloride, and polymethylmethacrylate. Examples of ceramics include zirconia, silica and alumina.

The substrate surface can have functional groups thereon to attach linker thereto or it can be devoid of functional groups. Some substrates have functional groups thereon, in which case, the substrate need not be functionalized to provide the functional groups. Examples of substrate materials which have functional groups include silica, polyvinyl chlorides, polystyrene, and polymethylmethacrylate. If the substrate has functional groups thereon, then attachment to the linker is straightforward. For instance, if silica is used as a substrate, then the pendant silanol groups (—Si—OH—) on the silica substrate are used to directly link the silanol groups of the silica substrate to a linker in a known way.

In another example where substrate is functionalized and, therefore, is provided with functional groups is where the substrate is polymethylmethacryate. In this instance, the hydrogen on the carboxylic group of the methylmethacrylate group is used to directly link to the linker in a known way.

In a situation where a substrate is devoid of a group to which a linker can be attached, a linker with functional groups at two locations thereon must be used or the substrate is functionalized to provide a functional group to which a linker can be attached.

The linker is non-polar and is characterized by a saturated hydrocarbon group that contains a minimum of 1 carbon atom and up to a large number of carbon atoms. In a preferred embodiment, the linker contains 1–40 carbon atoms. The linker can be a straight or a branched chain hydrocarbon and the more carbon atoms in the linker, the more likely that it will be a waxy solid. In a preferred embodiment, the linker is a straight chain hydrocarbon.

The longer the hydrocarbon chain on the linker the less soluble it will be in an aqueous medium and the more soluble it will be in a hydrocarbon medium. For extraction of a metal ion from an aqueous medium, the linker chain can be shorter, as short as 1–4 carbon atoms, whereas in a hydrocarbon medium, the linker can have a larger number of carbon atoms.

The linker can have functional groups between ends thereof as long as the groups do not interfere with the function of the immobilized chelant material, particularly the metal chelating property of the chelant itself, and do not adversely affect stability of the medium. Typically, the linker is an unsubstituted straight chain hydrocarbon.

Functional groups can appear on the linker to facilitate attachment of the linker to the substrate. If the substrate is devoid of a functional group, then the linker should contain at least two function groups—one functional group for chemical attachment to the substrate and the second functional group for chemical attachment to the chelant, assuming that the chelant is devoid of a functional group, which is typically the case. If the substrate is devoid of a functional group and the linker has only one functional group, then after attaching itself to the substrate through its sole functional group, the linker will not be able to attach itself to the chelant unless the chelant carries at least one functional group.

Typical functional groups which can be present on the substrate, the linker or the chelant include epoxides, halides, acid chlorides, anhydrides, acetates, nosylates, brosylates and tosylates. Of the halide functional groups, chlorides and bromides are preferred. If there is more than one functional group on the substrate, the linker or the chelant, the functional groups can be same or different, although, typically, they are same.

The substrate and the linker attached thereto are typically commercially available and can be purchased with a functional group attached to the linker. An example of such is agarose epoxide which can be schematically represented as follows:

A-L-F where:

A represents agarose, i.e., a galoctose polymer responsible for gel strength of agarose;

L represents a linker, i.e, a straight chain hydrocarbon

F represents the epoxide functional group.

Any metal chelant can be used to attach to a linker. Metal chelants are typically polar and, therefore, insoluble in a hydrocarbon medium but soluble in an aqueous medium. The linker can be attached to a substrate or it can be free. The chelant used dictates specificity for chelation for a particular metal or metals. Nitrogen-containing chelants, whether cyclic or acyclic, are preferred for metals, particularly copper. Especially preferred chelants for metals, particularly copper, include the following:

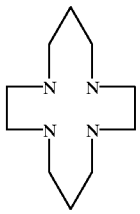

1,4,8,11
Tetraazacyclotetradecane
Cyclam

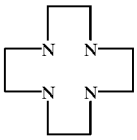

1,4,7,11
Tetraazacyclododecane
Cyclen

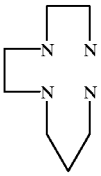

1,4,7,11
Tetraazaundecane
TAU

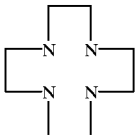

1,4,7,11
Tetraazadodecane
TAD

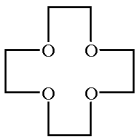

Crown Ether
CE

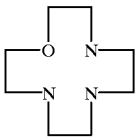

Oxa-Aza Crown Ether
OACE

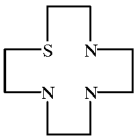

Thia-Aza Crown Ether
TACE

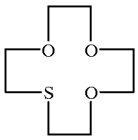

Thia-Oxa Crown Ether
TOCE

-continued

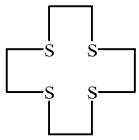

Thia-Crown Ether
TCE

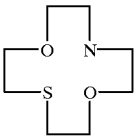

Aza-Oxa Thia Crown Ether
AOTCE

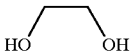

Monoethylene
Glycol MEG

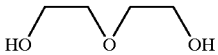

Diethylene
Glycol DEG

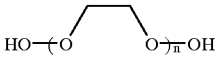

Polyethylene Glycol PEG

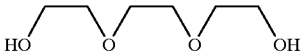

Triethylene Glycol TEG

Of the especially preferred chelants, multi-N containing chelants, such as cyclam, appear to be most preferred for copper, although it can chelate other metals at a reduced degree.

Although the chelators as such are used, it is possible to use modified chelants, particularly derivatives or precursors thereof, to achieve same or similar result.

Spent immobilized chelant material can be regenerated by washing it in an acid bath or by treating it with a solution containing high concentration of water-soluble chelator. Whichever regeneration approach is used, the object is to remove the metal from the complexed chelant without damaging the substrate/linker chelant complex.

The method for removing at least one ionic metal from liquid medium is characterized by the step of contacting the immobilized chelant material with a medium containing ionic metal or metals followed by separation of the material and the medium. Duration of the contacting step is typically from 1 second to 24 hours, more typically 2 seconds to 1 hour.

The step of contacting can be carried out in any manner such as stirring the material in the medium, flowing the material and the medium relative to each other, or any other manner which results in ionic metal complexation whereby the chelant reacts with the metal ions and thus attaches to the ionic metal that is soluble in the medium. It is believed that complexation between a chelant and ionic metal takes place in a known manner at ambient temperature on a 1:1 ratio where 1 molecule of a chelant complexes with one molecule of ionic metal. Duration of the contacting step will depend on relative concentration of the metal and the chelant, effectiveness of the chelant, temperature of the medium, type of medium, and other parameters.

A contacting step contemplated herein involves placing immobilized chelant material in a receptacle, such as an elongated tube, and passing the medium therethrough. Typically, duration of the contacting step in such an embodiment will be long enough to attain the desired metal complexation. In a commercial operation, it is desirable to keep duration of the contacting step to a minimum so that complexation can be accomplished on a continuous basis as the liquid medium is conveyed through the immobilized chelant material.

The metals suitable for complexation with the chelants disclosed herein are metals that are not alkali or alkalineearth metals but metals that have specific gravity exceeding 4 or atomic numbers equal to or greater than 22. The metals contemplated herein include copper, cobalt, mercury, lead, tungsten, zinc, arsenic, silver, uranium, cadmium, and tin. More than one metal can be complexed by the chelants herein. Of particular interest herein is copper due to its catalytic activity in a hydrocarbon medium, such as jet fuel.

Coppper in metallic form, as other metals, does not dissolve in a fuel. In a fuel or a hydrocarbon medium, copper is rendered ionic and while in ionic form, it is complexed with the metal chelators alluded to herein.

The medium suitable herein is aqueous solution or liquid hydrocarbon, such as jet fuel. Typically, the medium is liquid hydrocarbon of up to 40, more typically 6 to 24 carbon atoms. If the medium is a jet fuel, the jet fuel is typically JP-5 or JP-7.

Although jet fuel when made may be devoid of any metal, metal in the jet fuel can accumulate during handling thereof and with respect to copper, jet fuel can contain up to about 1 ppm of copper when it is injected into a jet engine. Since copper facilitates auto oxidation and affects thermal stability of a jet fuel, it is desirable to completely remove it or reduce its concentration to below 20 ppb, particularly below 10 ppb.

The step of separating the immobilized chelant material from is the medium can be accomplished in any practical way. If the material is mixed with the medium, separation can be achieved by filtration since the medium is liquid and the immobilized chelant material is solid or a heavier liquid. In a continuous operation wherein the immobilized chelant material is disposed in a filter-line tube, separation can be effected by conveying the medium through the tube packed with the material.

It is believed that the ionic metal that is removed from a liquid medium is complexed with an original or indigeneous or native chelant to form a complexed metal. When the immobilized chelant disclosed herein is introduced into the medium, the complexed metal ions are attracted to the immobilized chelant because it is stronger than the original chelant. What apparently results is that the metal ions leave the original weaker chelant and become complexed with the stronger immobilized chelant.

Having described the invention, the following examples are given as particular embodiments thereof and to demonstrate the practice and advantages thereof. It is understood that the examples are given by way of illustration and are not intended to limit the specification or the claims in any manner.

EXAMPLE 1

This example demonstrates preparation of immobilized chelant material using commercially obtained agarose epoxide and cyclam chelant.

The commercially obtained agarose epoxide contained a straight chain linker of 16 carbons terminated with an epoxide. The agarose epoxide contained 3 mmol of active epoxide per gram. The epoxide functional group on the agarose epoxide was initially broken and then reacted with cyclam.

Agarose is a neutral galactose polymer and was the substrate which had a plurality of linkers attached thereto and molecules of cyclam chelant attached to the linkers. This immobilized chelant material was in the form of a particulate solid.

EXAMPLE 2

This example demonstrates the use of immobilized chelant material prepared similarly to Ex. 1 from agarose epoxide and cyclam to remove copper metal ions.

Pursuant to the procedure, 0.1 gram of the agarose immobilized chelant material was stirred for 18 hours with 3.50 grams of dodecane doped with or containing 20 ppm of copper. The dodecane was then removed and filtered through glass wool and 0.45 micron plastic filter. Analysis of the residual copper in dodecane by ICP-graphite furnace indicated 0 ppb copper.

With JP-5 jet fuel containing 20 ppm doped copper in place of the doped dodecane, residual copper was 6 ppb.

EXAMPLE 3

This example demonstrates preparation of immobilized chelant material using commercially obtained chloromethylpolystyrene and cyclam.

Chloromethylpolystyrene containing 1 mmol chloride per gram was refluxed with excess diamino-octane in dimethyl formamide yielding aminated polystyrene in a suspension. The suspension was then filtered and washed successively with dimethyl formamide, water, chloroform, ethanol and methanol. The aminated polystyrene separated from the suspension was then stirred for 5 days with excess dibromooctane in dimethyl formamide. This suspension was filtered and the brominated polystyrene was then washed with methanol and stirred (reacted) with 1.5 grams of cyclam in dimethyl formamide. This suspension was then filtered, washed with chloroform and dried yielding a particulate solid product where the polystyrene was the subsrate with a plurality of linkers attached thereto with cyclam attached to the other end of the linkers. The linkers were two 8-carbon straight chains separated by an —NH—group.

EXAMPLE 4

This example demonstrates the use of the immobilized chelant material prepared similarly to Ex. 3 from chloromethylpolystyrene and cyclam to remove copper metal ions.

Pursuant to the procedure, 1.0 gram of the immobilized polystyrene chelant material was stirred for 18 hours with 3.50 grams of dodecane containing 20 ppm doped copper. The suspension was then stirred and then filtered through glass wool.

Analysis of the residual copper by ICP-graphite furnace indicated that 18 ppb copper remained.

EXAMPLE 5

This example demonstrates preparation of immobilized chelant material using aminopropyltrimethoxy silane and cylam chelant.

One mmol of aminopropyltrimethoxy silane was stirred overnight with 1 mmol of bromohexanoyl chloride in excess pyridine. The resulting solution was then filtered and the filtrate was stirred for 72 hours with 2 mmol of cyclam in chloroform. The resulting solution was then filtered and the residual oil was refluxed with silica in toluene. The silica had weight: weight ratio of silane to silica of 1:9. Toluene was then removed and the residual silica was washed in toluene. The linkers were attached at one end to the silica substrate and at the other end, to cylam molecules. The linkers were aminopropyl groups attached to the substrate at the propyl ends. The immobilized chelant material was in the form of a light syrup.

EXAMPLE 6

This example demonstrates the use of the immobilized chelant material prepared similarly to Ex. 5 from aminopropyltrimethoxy silane and cyclam to remove copper metal ions.

Pursuant to the procedure, 0.35 gram of the silica immobilized chelant material was stirred with 5.0 grams of dodecane containing 20 ppm doped copper. Dodecane was then removed and filtered through glass wool and 0.45 micron plastic filter. Analysis of residual copper in the treated dodecane by ICP-graphite furnace indicated 0 ppb copper remained.

With JP-5 jet fuel instead of dodecane, residual copper in the jet fuel was 1 ppb.

EXAMPLE 7

This example demonstrates preparation of immobilized chelant material using bromoalcohol with methacryloyl chloride and subsequent polymerization and treatment with cyclam.

One mmole of the bromoacrylate was treated with 1 mole of methacryloyl chloride in pyridine and ether which produced the bromoacrylate. The bromoalcohol used had an 8-carbon straight chain with a hydroxyl group at one end and the acrylate group at the opposite end. The bromoacrylate contained a bromide and acrylate groups separated by the 8-carbon chain. The bromoacrylate was then treated with an 8-fold excess of cyclam which produced the corresponding cyclam acrylate which was polymerized using the AIBN initiator to produce the immobilized chelant material. The immobilized chelant material was in the form of a thick syrup, had polymethymethacrylate substrate, linkers consisting of an 8-carbon straight chain attached at one end to the substrate, and cyclam molecules attached to the other end of the linkers.

EXAMPLE 8

This example demonstrates the use of immobilized chelant material prepared similarly to Ex. 7 from 1-bromo, 8-hydroxy octane, methacrloyl chloride and cyclam to remove copper metal ions.

Pursuant to the procedure, 0.8 gram of the acrylate immobilized chelant material was stirred for 18 hours with 5.0 grams of dodecane doped with 20 ppm copper. After removal and filtration, amount of residual copper in dodecane was 8 ppb. Filtration was through glass wool and 0.45 micron plastic filter and analysis of residual copper was by ICP-graphite furnace.

The acrylate polymeric immobilized chelant material removed from the above experiment in amount of 0.8 gram was re-stirred with 5.1 grams of JP-5 jet fuel doped with 20 ppm copper. The jet fuel was then removed and filtered through glass wool and 0.45 micron plastic filter. Analysis for residual copper by ICP-graphite furnace indicated that 9 ppb copper remained in the jet fuel after treatment with the acylate immobilized chelant material.

The error in all of the above residual copper determinations by the use of the ICP-graphite furnace was ±5 ppb.

While presently preferred embodiments have been shown of the invention disclosed herein, persons skilled in this art will readily appreciate that various additional changes and modifications may be made without departing from the spirit of the invention as defined and differentiated by the following claims.

What is claimed is:

1. A composition comprising a solid substrate, a linker, and a metal chelant, said linker being chemically attached to said substrate and to said chelant and wherein said metal chelant is selected from the group consisting essentially of cyclam, cyclen, 1,4,7,11-tetraazaundecane, 1,4,7,11-tetraazadodecane, a crown ether, an oxa-aza crown ether, a thia-aza crown ether, a thia-oxo crown ether, a thia-crown ether, an aza-oxa-thia crown ether, monoethylene glycol, diethylene glycol, triethylene glycol, polyethylene glycol, and mixtures thereof.

2. The composition of claim 1 wherein said metal chelant can chelate the ionic form or forms of a metal having a specific gravity exceeding 4.

3. The composition of claim 1 wherein said metal chelant is a chelant for a metal ion of atomic number equal to or greater than 22.

4. The composition of claim 1 wherein said metal chelant is a chelant for an ion selected from the group consisting of copper, mercury, lead, cobalt, tungsten, zinc, arsenic, silver, uranium, cadmium, tin, and mixtures thereof and wherein said linker is a saturated hydrocarbon containing 1–40 carbon atoms.

5. The composition of claim 1 wherein said chelant is cyclam and said linker is a saturated straight chain hydrocarbon containing up to 40 carbon atoms.

6. The composition of claim 1 wherein said chelant is cyclam and said linker is a saturated hydrocarbon containing 1–40 carbon atoms.

7. The composition of claim 1 wherein said linker is a hydrocarbon.

8. The composition of claim 7 wherein said linker is a saturated hydrocarbon containing 1–40 carbon atoms.

9. The composition of claim 7 wherein said substrate is selected from the group consisting of polyacrylate polymers, agarose, unsubstituted polystyrene, substituted polystyrene, silica, silica-containing polymers, and mixtures thereof.

* * * * *